US009151537B2

(12) United States Patent
Nilsen

(10) Patent No.: US 9,151,537 B2
(45) Date of Patent: Oct. 6, 2015

(54) METHOD AND SYSTEM FOR PRODUCING LIQUEFIED NATURAL GAS (LNG)

(75) Inventor: Inge Sverre Lund Nilsen, Bergen (NO)

(73) Assignee: Kanfa Aragon AS, Bergen (NO)

( * ) Notice: Subject to any disclaimer, the term of this patent is extended or adjusted under 35 U.S.C. 154(b) by 1368 days.

(21) Appl. No.: 12/640,026

(22) Filed: Dec. 17, 2009

(65) Prior Publication Data

US 2010/0154470 A1 Jun. 24, 2010

Related U.S. Application Data

(60) Provisional application No. 61/138,973, filed on Dec. 19, 2008.

(51) Int. Cl.

| | |
|---|---|
| ***F25J 1/00*** | (2006.01) |
| ***F25J 3/00*** | (2006.01) |
| ***F25J 1/02*** | (2006.01) |

(52) U.S. Cl.

CPC ..... *F25J 1/0022* (2013.01); *F25J 1/005* (2013.01); *F25J 1/0037* (2013.01); *F25J 1/0052* (2013.01); *F25J 1/0057* (2013.01); *F25J 1/0072* (2013.01); *F25J 1/0082* (2013.01); *F25J 1/0092* (2013.01); *F25J 1/0097* (2013.01); *F25J 1/0201* (2013.01); *F25J 1/0202* (2013.01); *F25J 1/0204* (2013.01); *F25J 1/0205* (2013.01); *F25J 1/0212* (2013.01);

(Continued)

(58) Field of Classification Search

CPC ..... F25J 1/0022; F25J 1/0216; F25J 1/005; F25J 1/0072; F25J 1/0092; F25J 1/0097; F25J 1/0201; F25J 1/0204; F25J 1/0205; F25J 1/0212; F25J 1/0215; F25J 1/0232; F25J 1/0238; F25J 1/0241; F25J 1/0278; F25J 1/0281; F25J 1/0288; F25J 1/0294; F25J 1/0082; F25J 1/0202; F25J 1/0037; F25J 2210/06; F25J 2220/64; F25J 2270/16; F25J 2270/90; F25J 3/0247; F25J 3/0214; F25J 3/065; F25J 2210/62; F25J 2215/66; F25J 2270/04; F25J 2280/02

USPC ..... 62/611, 612, 613, 614

See application file for complete search history.

(56) References Cited

U.S. PATENT DOCUMENTS

| | | | | |
|---|---|---|---|---|
| 2,546,349 | A * | 3/1951 | Scoville | 196/132 |
| 3,559,417 | A | 2/1971 | Hoffman | |

(Continued)

FOREIGN PATENT DOCUMENTS

| | | |
|---|---|---|
| DE | 10205366 | 8/2003 |
| EP | 1715267 | 10/2006 |

(Continued)

OTHER PUBLICATIONS

"MRC Cycle for LNG/Air Separation Saves Money" by D.T. Linnet, Tenth Australian Chemcial Engineering Conference, 1982.*

(Continued)

*Primary Examiner* — Frantz Jules
*Assistant Examiner* — Keith Raymond
(74) *Attorney, Agent, or Firm* — Christian Abel

(57) ABSTRACT

A method and system for optimizing the efficiency of an LNG liquification system of the gas expansion type, wherein an incoming feed gas is first separated in a fractionation column by counter current contact with a cold reflux fluid, and a gaseous stream introduced into the heat exchanger system at a reduced temperature such that an intermediate pinch point is created in the warm composite curve.

12 Claims, 11 Drawing Sheets

(52) U.S. Cl.
CPC ..... *F25J 1/0215* (2013.01); *F25J 1/0216* (2013.01); *F25J 1/0232* (2013.01); *F25J 1/0238* (2013.01); *F25J 1/0241* (2013.01); *F25J 1/0278* (2013.01); *F25J 1/0281* (2013.01); *F25J 1/0288* (2013.01); *F25J 1/0294* (2013.01); *F25J 2210/06* (2013.01); *F25J 2210/62* (2013.01); *F25J 2215/66* (2013.01); *F25J 2220/64* (2013.01); *F25J 2270/16* (2013.01); *F25J 2270/90* (2013.01)

(56) References Cited

U.S. PATENT DOCUMENTS

| | | | | | |
|---|---|---|---|---|---|
| 3,724,226 | A | * | 4/1973 | Pachaly | 62/613 |
| 4,690,702 | A | | 9/1987 | Paradowski | |
| 4,701,200 | A | | 10/1987 | Fisher | |
| 5,264,187 | A | * | 11/1993 | Olbrich et al. | 422/612 |
| 5,325,673 | A | * | 7/1994 | Durr et al. | 62/634 |
| 6,308,531 | B1 | * | 10/2001 | Roberts et al. | 62/611 |
| 6,401,486 | B1 | | 6/2002 | Lee | |
| 6,539,747 | B2 | * | 4/2003 | Minta et al. | 62/620 |
| 6,662,589 | B1 | | 12/2003 | Roberts | |
| 6,742,358 | B2 | | 6/2004 | Wilkinson | |
| 7,010,937 | B2 | | 3/2006 | Wilkinson et al. | |
| 2006/0260355 | A1 | * | 11/2006 | Roberts et al. | 62/620 |

FOREIGN PATENT DOCUMENTS

| | | |
|---|---|---|
| WO | 2005/071333 | 8/2005 |
| WO | 2006/115597 | 11/2006 |
| WO | 2006/123240 | 11/2006 |
| WO | 2009/017414 | 2/2009 |

OTHER PUBLICATIONS

D.T. Linnett, "MRC Cycle for LNG/Air Separation Saves Money", Tenth Australian Chemical Engineering Conference, 1982, Sydney, Aug. 24-26.

* cited by examiner

Prior Art

Prior Art

METHOD AND SYSTEM FOR PRODUCING LIQUEFIED NATURAL GAS (LNG)

This application claims the benefit under 35 USC §119(e) of U.S. provisional application 61/138,793 filed 19 Dec. 2008.

FIELD OF THE INVENTION

The present invention relates to a method for optimal production of LNG.

BACKGROUND

As used herein, the term LNG shall refer to Liquefied Natural Gas, that is Natural gas that has been cooled down such that it condenses and becomes liquid.

As used herein, the term Natural Gas shall refer to a gaseous mixture of hydrocarbons where an essential part is methane.

As used herein, the term LPG shall refer to Liquid Petroleum Gas, that is a gaseous mixture of hydrocarbons comprising propane and butanes.

As used herein, the term "mixed refrigerant cycle" shall refer to a liquification process, known in the art, employing an optimized mixture of a plurality of refrigerants.

As used herein, the term "gas expansion process" or "gas expansion cycle" shall refer to a liquefaction process, known in the art, employing a gaseous cooling agent, wherein the gaseous cooling agent at a higher pressure is first fed to a heat exchanger system and cooled but such that the cooled cooling agent is a gas. Thereafter the cooled cooling agent is expanded in a gas expander to a lower pressure lower than said higher pressure to generate a cold gaseous cooling agent stream. The cold gaseous cooling agent is led back to the heat exchanger system where it cools down the cooling agent stream at the higher pressure and for heat exchange with the fluid that is to be cooled, such as a gas to be liquefied, and such that the said cold gaseous cooling agent becomes a heated cooling agent. The heated cooling agent is thereafter compressed for reuse.

As used herein, the term "warm composite curve", as known in the art, shall refer to the heat flow versus temperature relationship for the sum of warm streams being cooled down in a heat exchanger or a system of heat exchangers.

As used herein, the term "cold composite curve", as known in the art, shall refer to the heat flow versus temperature relationship for the sum of cold streams being heated in a heat exchanger or a system of heat exchangers.

A used herein, the term "warm end" of a liquefaction heat exchanger, as known in the art, shall refer to the area or range of the heat exchanger where the warmest streams involved in the heat exchange is entering or leaving the heat exchanger.

As used herein, the term "split gas expansion cycles" shall refer to a gas expansion cycle wherein the cooled refrigerant is split into a plurality of streams, the streams being utilized at different stages and at different temperatures in the cooling of the target fluid.

As used herein, the term "fractionation column" shall refer to an arrangement, known in the art, for distillation separation of a mixed hydrocarbon fluid, in particular a column that generates an overhead fraction and bottom fraction It is known in the art to produce LNG from a feed gas comprising a mixture of hydrocarbons, wherein the feed gas first passes through a fractionation column and an overhead fraction subjected to the liquefaction process, for example the system disclosed in EP 1715267. Such systems are employed in large scale, so-called "base load" liquefaction systems. Such systems typically employ a mixed refrigerant cycle, due to the superior efficiency of the mixed refrigerant cycle compared to the gas expansion cycle. Because the mixed refrigerant mixture is optimized, the overhead fraction must be cooled by an external source prior to being fed into the liquefaction circuit. As it is the intention of such systems to achieve an LNG product with as high a relative content of methane as possible, these systems are further arranged such that the bottom fraction from the fractionation column comprises a relatively high content of hydrocarbons heavier than methane.

The simplest way to limit the content of heavier hydrocarbons in the liquid gas is to partially condense the gas and then separate the condensed liquid from the gas, which is further cooled to be liquefied. The separation is normally carried out as an integrated part of the cooling down process at typical temperatures of between 0° C. and −60° C. Separated condensate can be heated up again as a part of the cooling process to utilise the cooling potential.

In large land based LNG installations (so called "base load" installations) most of the propane and heavier hydrocarbons are normally removed and in many cases also a considerable part of ethane, before or as a part of, the liquefaction. This is done to meet the sale specifications and to be able to produce and sell the valuable ethane, LPG and condensate/naphtha. Elaborate processes are normally used with low temperature fractionation columns both as a part of the cooling down process and as separate units outside the cooling system.

Because of the complexity of large, "Base load" systems, the arrangements used therein are not suitable for many applications, for example offshore applications. In addition, it is undesirable to handle products other than the LNG, as hydrocarbons lighter than C5 can, on the whole, not be stored or transported safely without being cooled down or under pressure.

In such offshore applications it is known to utilize the gas expansion cycle for the liquefaction of natural gas. The gas expansion cycle is relatively simple, but is less efficient than the mixed refrigerant cycle. While the use of the "split gas expansion cycle" can improve efficiency there is nonetheless a need for greater efficiency, as even relatively small changes in efficiency can result in very large economic gains.

SUMMARY OF THE INVENTION

It is therefore an object of the invention to provide a more efficient liquification system employing the gas expansion cycle. It is also an object of the invention to provide a system in which the LNG product is enriched in ethane, propane, butane, and to a lesser degree pentane.

According to one aspect of the invention is provided a method comprising a fractionation column for feeding in of a feed gas, a heat exchanger system for cooling down and partially condensing the overhead gas stream of the fractionation column, a separator to separate the two-phase stream from the heat exchanger system and an appliance for return of fluid from the separator to the fractionation column and feeding this fluid to the upper part of the column as reflux, and an appliance to feed the gas from the separator back to the heat exchanger system for further cooling down and liquefaction to LNG. The invention comprises a closed gas expansion process to liquefy the natural gas, wherein the gas is first fed through a fractionation column where the gas is cooled and separated into an overhead fraction with reduced content of hexane (C6) and heavier components, and a bottom fraction enriched with the heavier hydrocarbons (C6+), furthermore, in that the fractionation column reflux is generated as an integrated part of the system for liquefaction in that the overhead gas is partially condensed. By carrying out the liquefaction in accordance with the invention, production of liquid gas with maximum content of ethane, propane and butane (C2-C4) is achieved at the same time as the efficiency of the gas expansion process is increased and the by-production of unstable/volatile fluid with a high content of methane, ethane, LPG (propane+butane) is minimised.

In particular, the invention comprises a method and a system for liquefaction of natural gas or other hydrocarbon gas from a gas field or from a gas/oil field, where it is appropriate to liquefy the gas to make it possible to transport the gas from the source to the market. This is particularly relevant for oil/gas fields at sea.

The aim of the invention is to render liquefaction of gas energy efficient at the same time as the process is kept simple so that the equipment can be used offshore. In particular the invention is useful on floating installations since the by-production of condensate during the liquefaction is minimised and the efficiency is maximised (the need for fuel gas is minimised).

The method according to the invention is characterised by the following steps:

1) that the feed gas is led through a fractionation column (150) where it is cooled and separated into an overhead fraction with reduced content of C6 hydrocarbons and heavier components, and a bottom fraction enriched with heavier hydrocarbons, 2) that the overhead fraction from the fractionation column is fed into a heat exchanger system (110) and is subjected to a partial condensing to form a two-phase fluid, and the two-phase fluid is separated in a suitable separator (160) to a liquid (5) rich in LPG and pentane (C3-C5) which is re-circulated as cold reflux to the fractionation column (150), while the gas (6) containing lower amounts of C5 hydrocarbon and hydrocarbons heavier than C5, is led off for further treatment in the heat exchanger system (110) for liquefaction to LNG with maximum content of ethane and LPG, and 3) that the cooling circuit for liquefaction of gas in the heat exchanger system comprises an open or closed gas expansion process with at least one gas expansion step.

The system according to the invention is characterised in that the cooling system which is used for cooling down, condensing and liquefaction of the gas in the heat exchanger system comprises an open or closed gas expansion process with at least one gas expansion step. The system is preferably designed and configured to separate the feed gas so that the LNG product from the system will be enriched with most of the butane (C4) and hydrocarbons with a lower normal boiling point than butane, and the bottom product of the fractionation column will be enriched with most of C6 and components with a normal boiling point higher than C6.

The present invention represents a considerable optimisation for application offshore, and especially on a floating unit, in that a relatively simple and robust gas expansion process is used for liquefaction of natural gas, and in that the energy efficiency of this process is increased at the same time as the amount of liquid gas is maximised by maximising the content of ethane and LPG, at the same time as the amount of hydrocarbons heavier than methane which is separated out as bi-products in the liquefaction process is minimised.

An installation which comprises the system according to the invention can thereby simply be adapted and be installed, for example, on board floating offshore installations where space is often a limiting factor.

BRIEF DESCRIPTION OF THE FIGURES

The invention will now be described in more detail with reference to the enclosed figures in which.

DETAILED DESCRIPTION OF THE INVENTION

Figure 1:
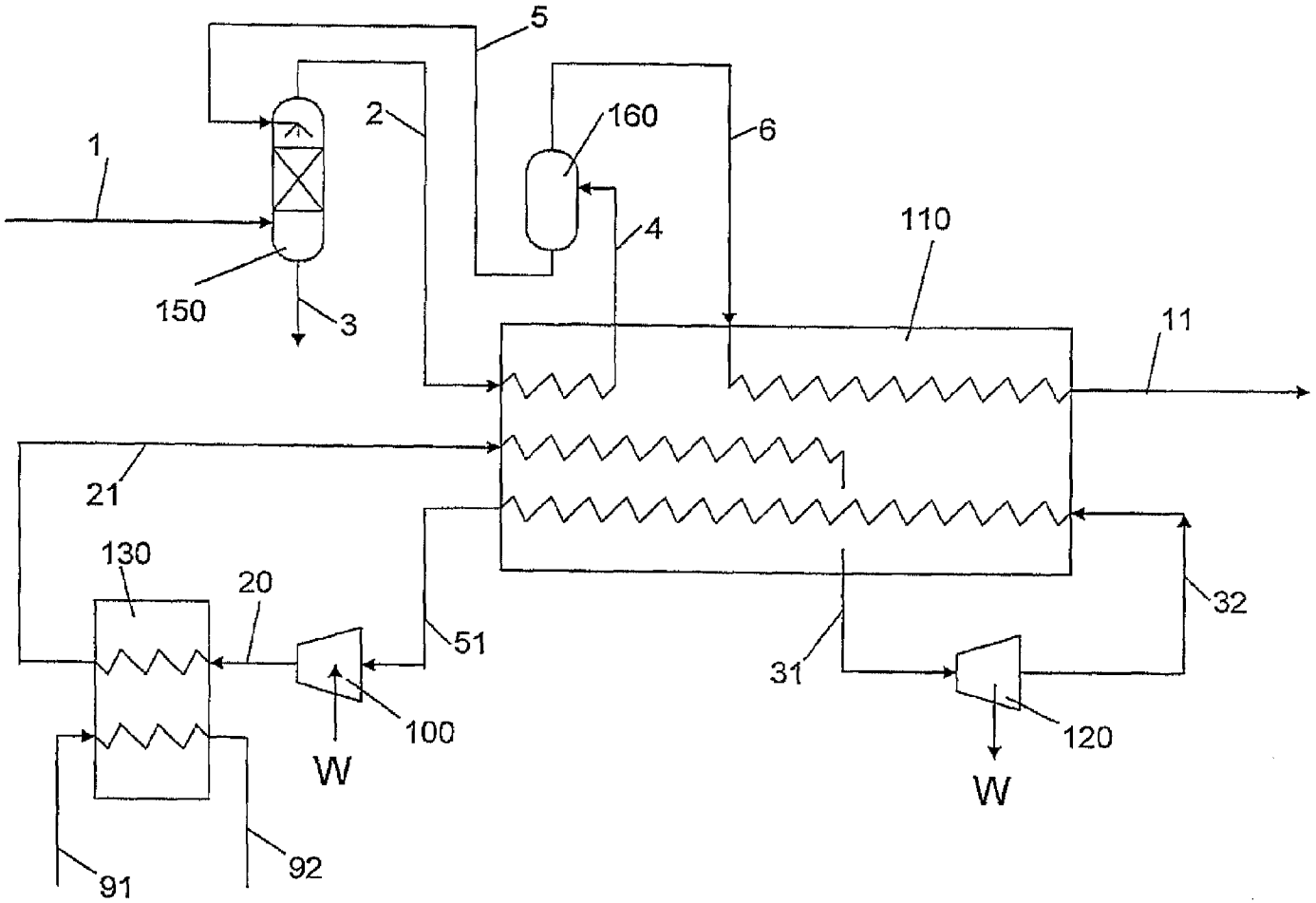
FIG. 1 shows a principal embodiment with main components and main method of action.

With reference to FIG. 1 the system for optimised liquefaction of gas comprises, as a minimum, the following principle components:

- an incoming gas stream 1 which shall be cooled down and liquefied,
- a fractionation column 150 in which the incoming gas is cooled and is separated into an overhead fraction 2 with a reduced content of C6 and heavier components,
- a bottom fraction 3 enriched with the heavier hydrocarbon components,
- a system of heat exchangers 110, in which the incoming gas is cooled down and partially condensed for separation of heavier hydrocarbons for subsequent cooling down and liquefaction,
- a product stream 11 that encompasses a cooled down and liquefied gas,
- a product stream 3 which, in the main, encompasses pentane and heavier hydrocarbons, and
- a cooling system for cooling down and liquefying the gas comprising a gas cooling agent stream 20, at least one circulation compressor 100, at least one aftercooler 130, at least one gas expander 120.

Incoming and cleaned feed-gas 1, for example, a methane rich hydrocarbon gas, is first fed to a fractionation column 150, where the gas is cooled down when it meets a colder reflux fluid. During the cooling down and counter current contact with the colder fluid, the feed gas is separated into an overhead fraction 2 with a reduced content of the hydrocarbons that have a molecular weight higher than pentane (C5), and a bottom fraction 3 enriched with C6 and hydrocarbons that have a higher molecular weight than C6. The overhead fraction 2 of the fractionation column is then led to the heat exchanger system 110, where the gas is cooled down and partially condensed so that the resulting two-phase fluid 4 can be separated in a suitable separator 160. A fluid 5 rich in LPG and pentanes (C3-C5), which is separated in the separator 160, is re-circulated as cold reflux to the fractionation column 160. As this fluid is generated by condensation by cooling down, the reflux fluid 5 will have a lower temperature than the feed gas 1. The gas 6 from the separator 160 has now further reduced its content of C5 hydrocarbons and hydrocarbons higher than C5. This gas is then led back to the heat exchanger system 110 for further cooling down, condensation and sub-cooling. The liquid gas 11 is alternatively led through a control valve 140 that controls the operating pressure and flow through the system.

In a preferred embodiment the gas feed stream 1 is cooled down in advance by a suitable external cooling agent such as available air, water, seawater or a separate suitable cooling installation/pre-cooling system. For the latter external cooling method, a separate closed, mechanical cooling system with propane, ammonia or other appropriate cooling means is often used.

In a preferred embodiment the fractionation column 150 and the separator 160 are operated at pressures and temperatures that lead to the complete system (the fractionation column 150 and reflux separator 160) generating a component split/separation point in the normal boiling point area (NBP) between −12° C. and 60 C. This can, for example, correspond to the light key component for the separation being butane (C4) with a normal boiling point between −12° C. and 0° C., and the heavy key component being a C6 component with a boiling point between 50° C. and 70° C. The overhead gas stream 6 of the system will then be enriched with most of the butane (C4) and hydrocarbons with a lower normal boiling point than butane. The bottom product 3 from the fractionation column will be enriched with most of C6 and components with a normal boiling point higher than C6, while pentane (C5, NBP=28–36° C.) is a transitional component which is distributed in the gas product of the system and the bottom product from the fractionation column.

Cooling down and condensing of the feed gas in the heat exchanger system 110 is provided by a closed or open gas expansion process. The cooling process starts in that a gaseous cooling agent 21 encompassing a gas or a mixture of gases (such as pure nitrogen, methane, a hydrocarbon mixture, or a mixture of nitrogen and hydrocarbons), at a higher pressure, preferably between 3 and 10 MPa, is fed to the heat exchanger system 110 and cooled to a temperature between 0° C. and −120° C., but such that the cooling agent stream is mainly a gas at the prevailing pressure and temperature 31. The pre-cooled gaseous cooling agent 31 is then led into a gas expander 121 where the gas is expanded to a lower pressure between 5%-40% of the inlet pressure, but preferably to between 10% and 30% of the inlet pressure, and such that the cooling agent mainly is in the gas phase. The gas expander is normally an expansion turbine, also called turboexpander, but other types of expansion equipment for gas can be used, such as a valve. The flow of pre-cooled gaseous cooling agent is expanded in the gas expander 121 at a high isentropic efficiency, such that the temperature drops considerably. In certain embodiments of the invention, some liquid can be separated out in this expansion, but this is not necessary for the process. The cold stream of cooling agent 32 is then led back to the heat exchangers 110 where it is used for cooling down and possibly condensing of the other incoming hot cooling agent streams and the gas that shall be cooled down is condensed and subcooled.

After the streams 32 of cold cooling agent have been heated in the heat exchanger system 110, the cooling agent will exist as the gas stream 51, which in a closed loop embodiment is recompressed in an appropriate way for reuse and is cooled with an external cooling agent, such as air, water, seawater or an appropriate cooling unit.

Alternatively, the cooling system in an open embodiment will use a cooling agent 21 consisting of a gas or a mixture of gases at a higher pressure produced by an appropriate source, for example, from the feed gas that is to be treated and cooled down. Furthermore, the open embodiment will encompass a low pressure cooling agent flow 51 used for other purposes or, in an appropriate way, be recompressed to be mixed with the feed gas that is to be treated and cooled down.

In a preferred embodiment, the returning cooling agent stream 51 is led from the heat exchanger 110 to a separate compressor 101 driven by the expansion turbine 121. In this way, the expansion work is utilised, and the energy efficiency of the process is improved. After the compressor 101, the cooling agent is cooled further in a heat exchanger 131, before the stream is further compressed in the circulation compressors 100. The circulation compressors 100 can be one or more units, possibly one or more steps per unit. The circulation compressor can also be equipped with intermediate cooling 132 between the compressor steps. The compressed cooling agent 20 is then cooled by heat exchange in an aftercooler 130 with the help of an appropriate external cooling medium, such as air, water, seawater or a suitable separate cooling circuit, to be reused as a compressed cooling medium 21 in a closed loop.

In a preferred embodiment, the system of heat exchangers 110 is a heat exchanger which comprises many different "hot" and "cold" streams in the same unit (a so-called multi-stream heat exchanger).

Figure 2:
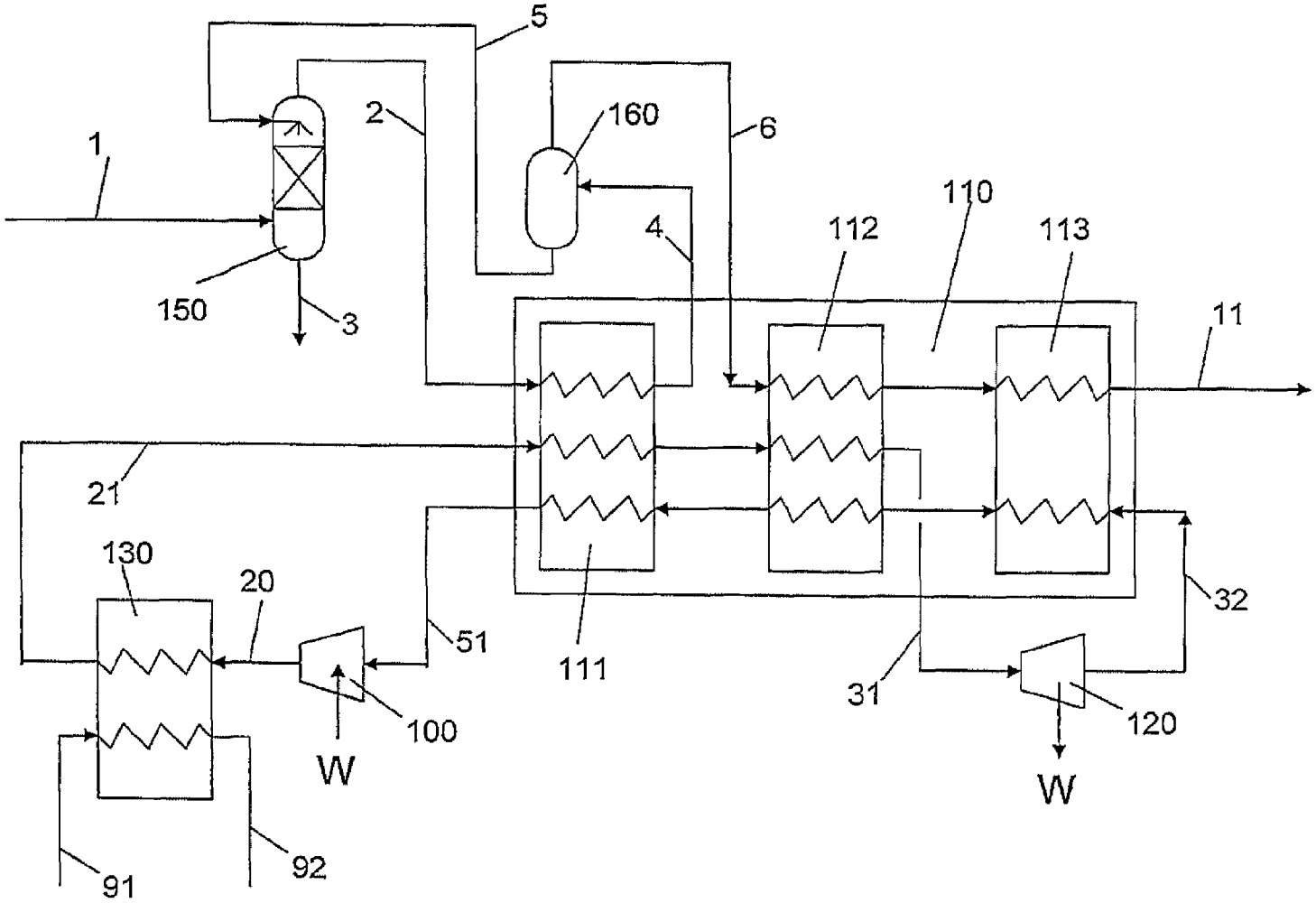
FIG. 2 shows the invention with an alternative embodiment.

FIG. 2 shows an alternative embodiment where several multi-stream heat exchangers are connected together in such a way that the necessary heat transfer between the cold and hot streams can be brought about. FIG. 2 shows a heat exchanger system 110 comprising of several heat exchangers in series. However, the invention is not related to a specific type of heat exchanger or number of exchangers, but can be carried out in several different types of heat exchanger systems that can handle the necessary number of hot and cold process streams.

Figure 3:
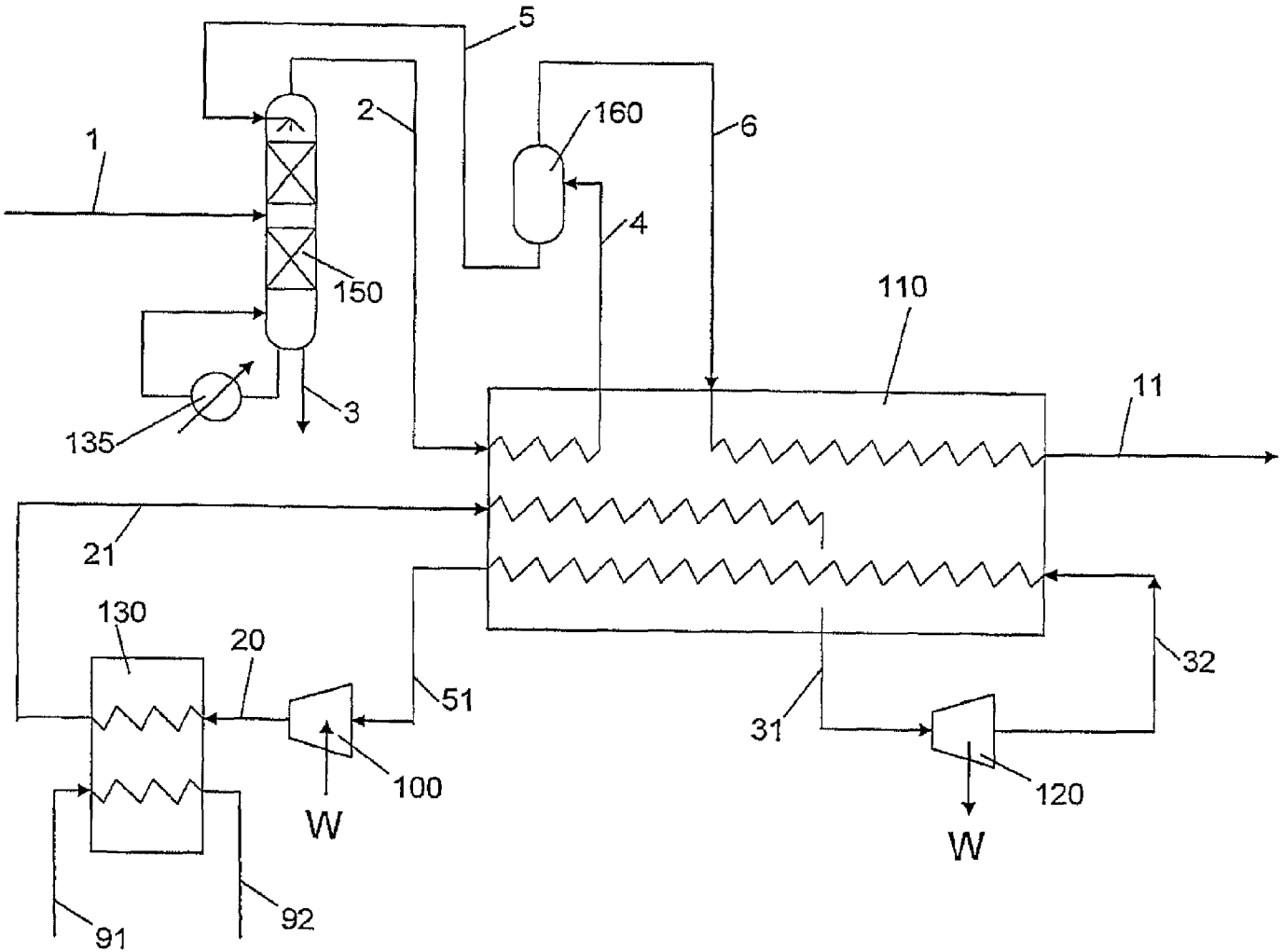
FIG. 3 shows the invention with an alternative embodiment that includes further stabilisation of the heavier hydrocarbons that are separated out (condensate).

FIG. 3 shows an alternative embodiment where the fractionation column 150 is fitted with a reboiler 135 to further improve the separation (a sharper split between light and heavy components), and also to reduce the volatility of the bottom fraction in the column. This can be used to directly produce condensate which is stable at ambient temperature and atmospheric pressure.

Figure 4:
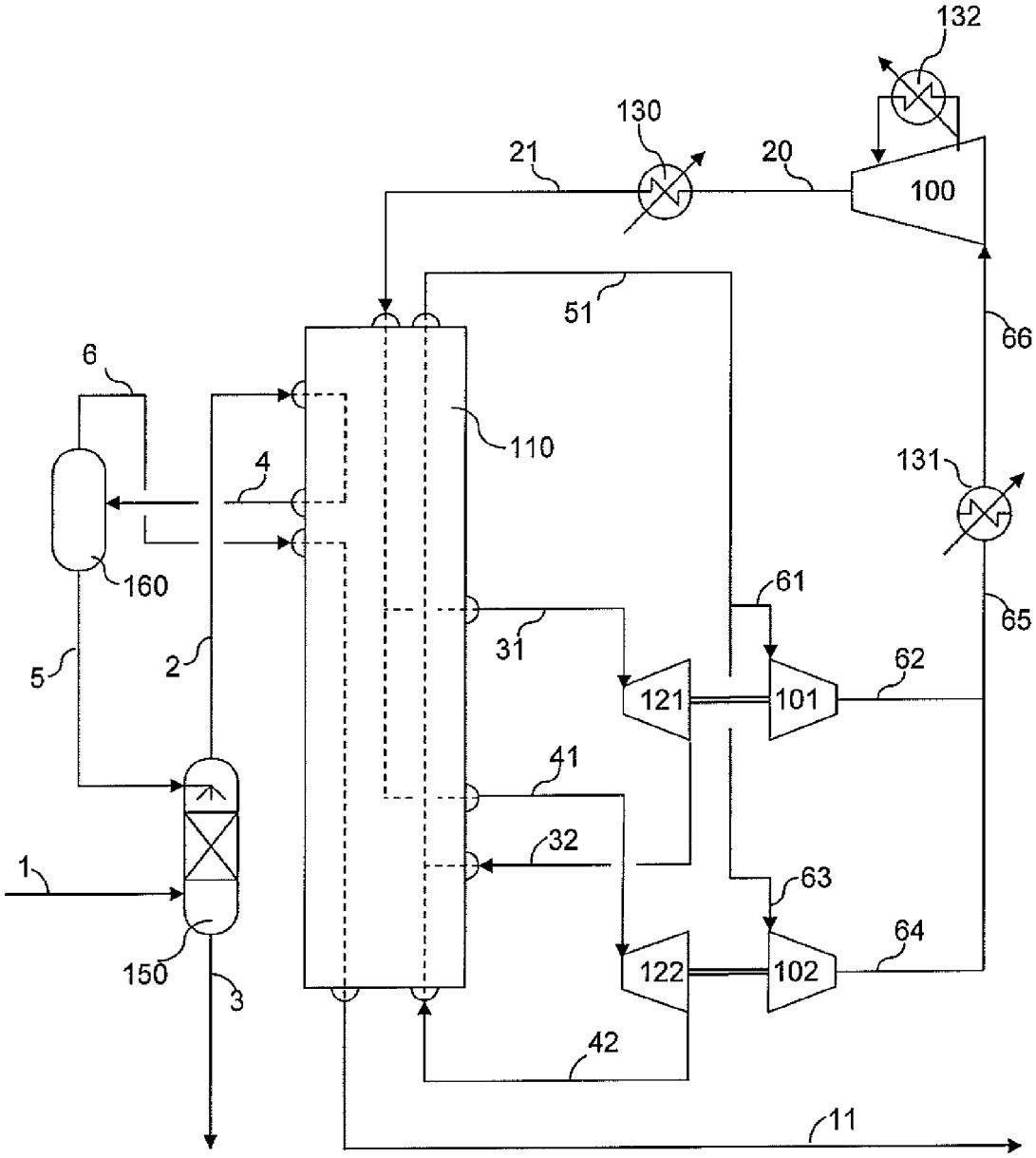
FIG. 4 shows the invention in detail carried out by using a double gas expansion process.

FIG. 4 shows the invention in detail carried out in a more advanced embodiment where a double gas expansion process is used. In this embodiment, the compressed cooling agent stream 21 is first cooled down to an intermediate temperature. At this temperature, the cooling agent stream is divided into two parts, where the one part 31 is taken out of the heat exchanger and is expanded in the gas expander 121 to a low pressure gas stream 32. The other part 41 is pre-cooled further to be expanded in the gas expander 122 to a pressure essentially equal to the pressure in stream 32. The expanded cold cooling agent streams 32, 42 are returned to different inlet locations on the heat exchanger system 110 and are combined to one stream in this exchanger. Heated cooling agent 51 is then returned to recompression. In an alternative embodiment to the system in FIG. 3, the compressed cooling agent stream 20 in the double gas expansion circuit can be split into two streams before the heat exchanger 110 to be cooled down to different temperatures in separate flow channels in the heat exchanger 110.

The same goes for the heating of the returned cold cooling agent streams 32, 42. The embodiment is otherwise in accordance with FIG. 3.

Figure 5:
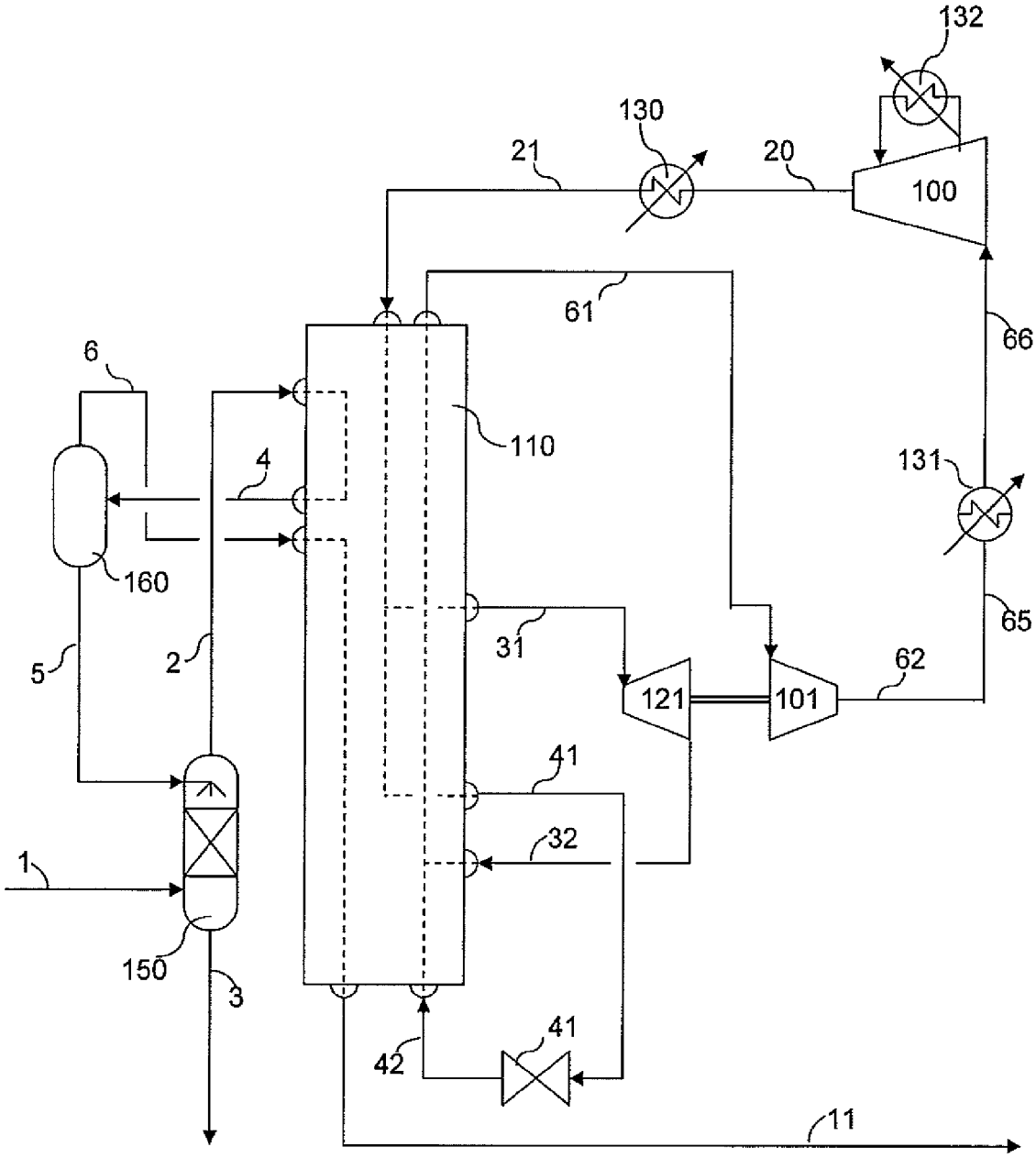
FIG. 5 shows the invention carried out by using a hybrid cooling circuit with a gas expansion loop and a liquid expansion loop.

FIG. 5 shows in detail the invention carried out with the use of a hybrid cooling loop where one and the same cooling agent is used both in a pure gas phase and in a pure liquid phase. In this embodiment a closed cooling loop provides the cooling down of the feed gas in the heat exchanger system 110. Said cooling loop starts by methane or a mixture of methane and nitrogen, where methane makes up at least 50% of the volume, being compressed and aftercooled to a compressed cooling agent stream 21, and where this cooling agent stream is pre-cooled, and at least a part 31 of the cooling agent stream is used in the gas phase in that it is expanded across a gas expander 121 and that at least a part 41 of the cooling agent stream is condensed to liquid and is expanded across a valve or liquid expander 141.

It is emphasised that the embodiment of the invention is not limited to the cooling processes described above only, but can be used with any gas expansion cooling process for liquefaction of natural gas or other hydrocarbon gas, where the cooling down is mainly achieved by using one or more expanding gas streams.

By carrying out the liquefaction of the natural gas in accordance with the invention, a product of liquid gas is produced which has a maximum content of methane, ethane and LPG, but which, at the same time, does not contain more than the permitted level of pentanes (C5) and heavier hydrocarbons with a normal boiling point above 50-60° C. At the same time, the content of volatile methane, ethane, propane and butane in the by-produced liquid (condensate/NGL) is considerable minimised or eliminated, At the same time more liquid natural gas will also be produced with lower energy consumption than for corresponding cooling circuits configured without the fractionation column which receives cold reflux enriched with C3-C5 from the cooling down process.

In addition to optimising the split between light components, which are wanted in the LNG product, and heavy hydrocarbons, which are wanted in the condensate by product, the invention significantly reduces the energy (gas compression power) required for liquefaction, when a gas expansion cooling cycle is used.

The main reason for the performance improvement when using gas expansion cooling is related to the fact that gas expansion cycles are characterised by relatively linear heat flow vs. temperature relations in the heat exchanger system (100). The exception is an area/range when significant hydrocarbon condensation (liquefaction) occurs but this is limited to a section of the entire cooling range. Due to the linear heat vs temperature relation, the performance of such cooling processes is normally limited by temperature pinch points. Most optimised gas expansion cycles have one pinch point in the warm end and one pinch point in the cold end, and in addition normally one or more temperature pinches in the hydrocarbon condensation area, as shown in FIG. 6*b*.

Figure 9:
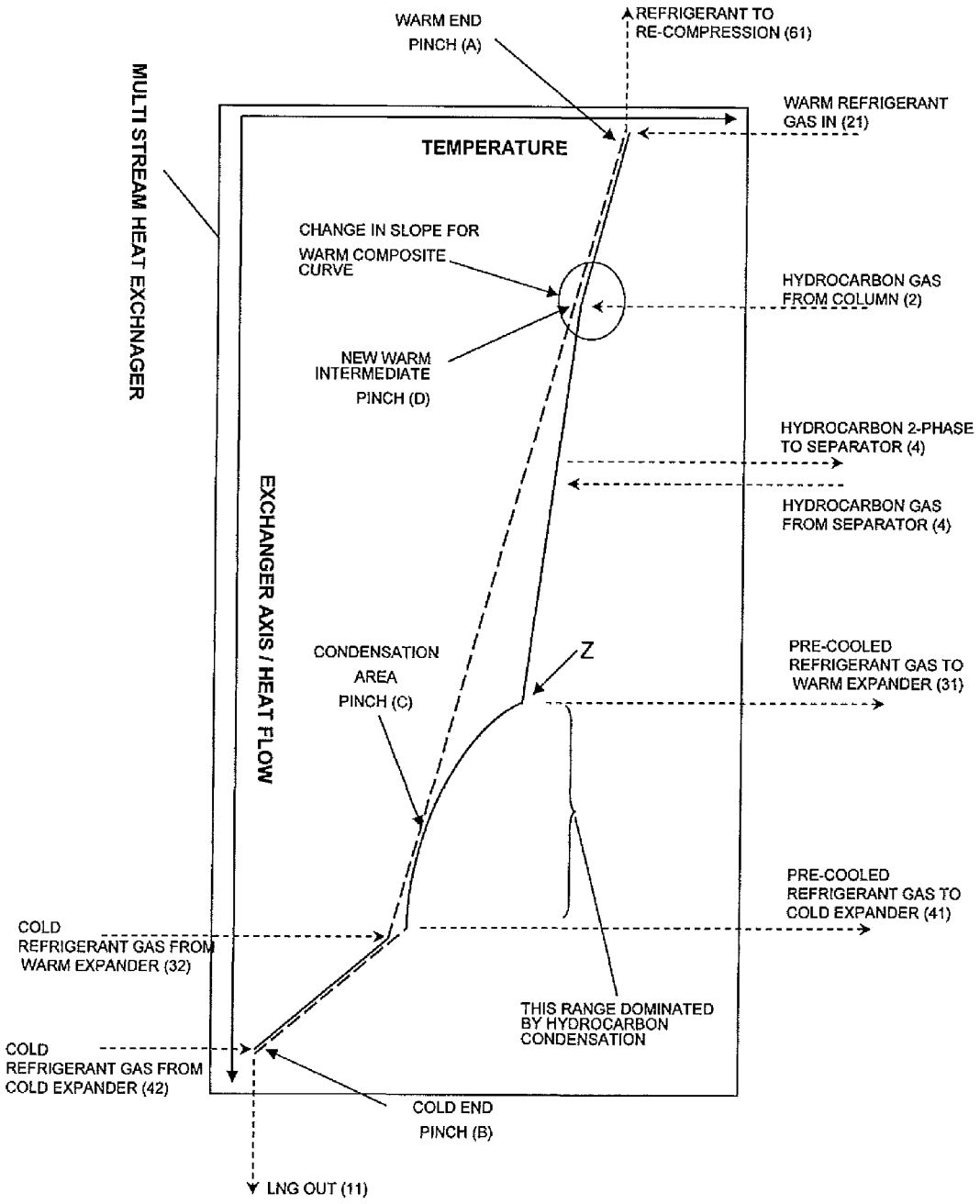
FIG. 9 shows the warm temperature curve and the cold temperature curve (composite curve) for the closed split-flow gas expansion circuit obtained by using the present invention, with additional details and references to inlet and outlet streams.

For the energy consumption required for cooling, liquefaction and subcooling a methane rich hydrocarbon gas, particularly the warm end pinch is an important limitation for reduced compression power, as it sets the lower limit for refrigerant gas mass flow. This can be seen in FIG. 6*b*, wherein the slope of the warm curve is continuous from point Z to the warm end pinch point (The distance between cold composite curve and the warm composite curve representing thermodynamic inefficiency). When introducing the hydrocarbon feed gas to be liquefied (2) at reduced temperature compared to the warm end temperature, according to the invention, an intermediate pinch point is created in the warm curve, as shown in FIG. 7*b* and FIG. 9. As shown therein, the slope of the upper part of the warm composite curve (sum of all warm streams being cooled down in that area), from this intermediate pinch point to the warm end pinch point, is closely matched and the warm end pinch is no longer the controlling factor with respect to the minimum refrigerant mass flow. A new intermediate/sub pinch is introduced; however, it is possible to reduce refrigerant mass flow, causing a general reduction of the distance between the hot and cold cooling curves (the better temperature adaptation reduces energy loss in the cooling cycle), but at the same time achieve the same net cooling work. In summary the required compression work will be reduced. Even though it is known to introduce cooled feed gas into a mixed refrigerant cycle, the energy reduction will not be significant in that case since these processes generally have much better adaptation between the warm and cold streams in the heat exchanger, and hence already lower energy loss. When introduced into a gas expansion cycle as provided by the current invention, however, the significant increases in efficiency are realized, as a comparison between FIGS. 6*b* and 7*b* demonstrate.

The difference between a conventional gas expander process and the gas expander process according to the invention shall now be explained closer with reference to FIGS. 6-9.

Figure 6A:
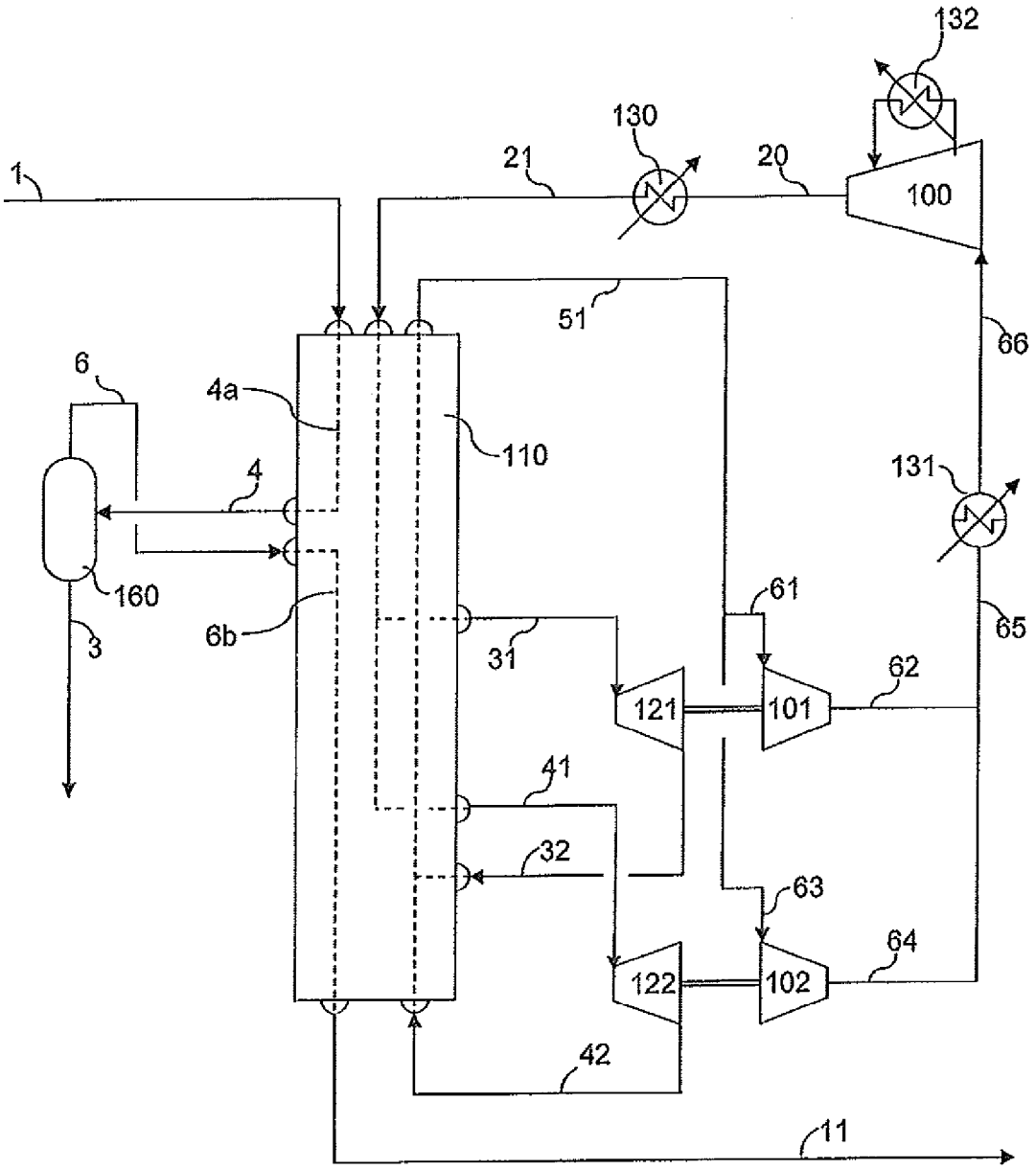
FIG. 6*a* shows a conventional, prior art, split flow closed gas expansion cooling cycle for pre-cooling, condensation and sub cooling of natural gas
Figure 6B:
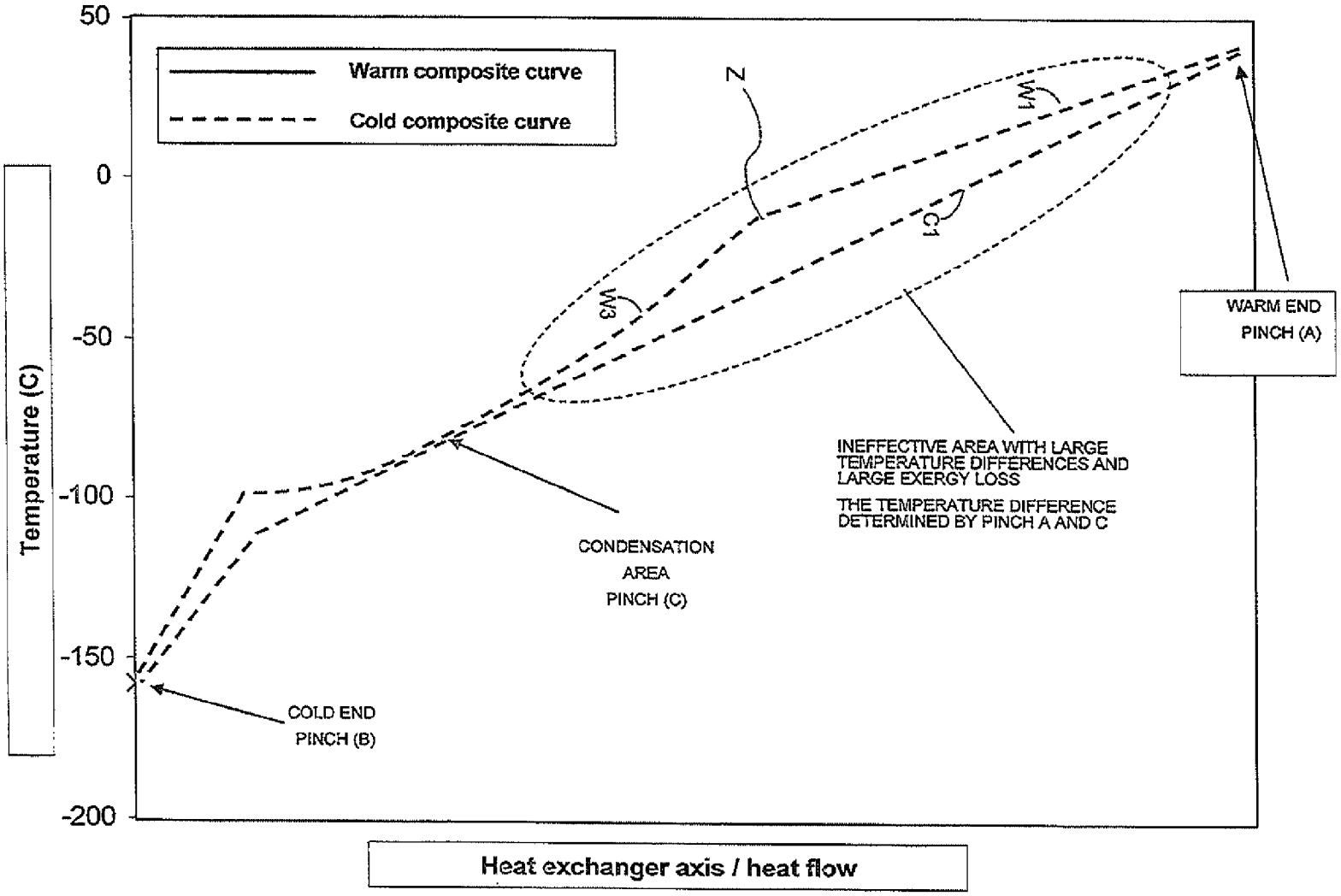
FIG. 6*b* shows an example of a hot temperature curve and a cold temperature curve (composite curve) for a conventional closed split-flow gas expansion circuit as shown in FIG. 6*a*.

FIG. 6*a* shows a conventional dual (split flow) closed gas expansion process for cooling, condensing and sub cooling an incoming gas stream (1). Heavy hydrocarbons are first removed conventionally by precooling the incoming feed gas (1) to an intermediate temperature 2-phase stream (4) in a heat exchanger system (100) by means of the dual gas expansion cooling system, separation of said stream in a separator (160), leading the overhead gas (6) from the separator back to the heat exchanger system for further cooling, condensation and sub cooling, and leading the heavy liquid stream (3) out of the system. With reference to FIG. 6*b*, in the warm end of the heat exchanger the warm composite curve (sum of warm streams being cooled down) is normally not affected by the small change in mass flow related to separation of the relatively small liquid stream (3), and the first part (W1) of the warm composite curve, which consists of warm, high-pressure gaseous cooling agent streams 31 and 41, and the hydrocarbon streams 4*a* and 6*b*, is therefore almost linear. Linearity is caused due to a linear relation between heat flow from the streams and the stream temperatures, since no significant condensation of hydrocarbons takes place in streams 4*a* and 6*b*. At the point where nitrogen stream 31 is extracted for expansion, the warm composite curve (W3) is consisting of the smaller cooling agent stream 41 and the hydrocarbon stream 6*b*, where the latter is starting to condense. The W1 curve is now strongly controlled by condensation, therefore the curved shape. The curved shape creates a pinch point (pinch C) at some temperature. In the same temperature range, the cold composite curve (C1) (sum of all cold streams being heated) is consisting of cold gaseous cooling agent streams 32 and 42 being heated. The streams are pure gaseous and heat flow vs. temperature has a linear relation, hence are the C1 composite curve linearly shaped. From FIG. 6*b* it can be seen that an envelope is formed, limited by the warm end pinch point (pinch A) and the condensation area pinch point (pinch C). In the envelope the general temperature differences are large and this means high energy loss, causing higher demand for compression work in the cooling cycle. In practise this can be seen as higher cooling agent flow rate.

Figure 7A:
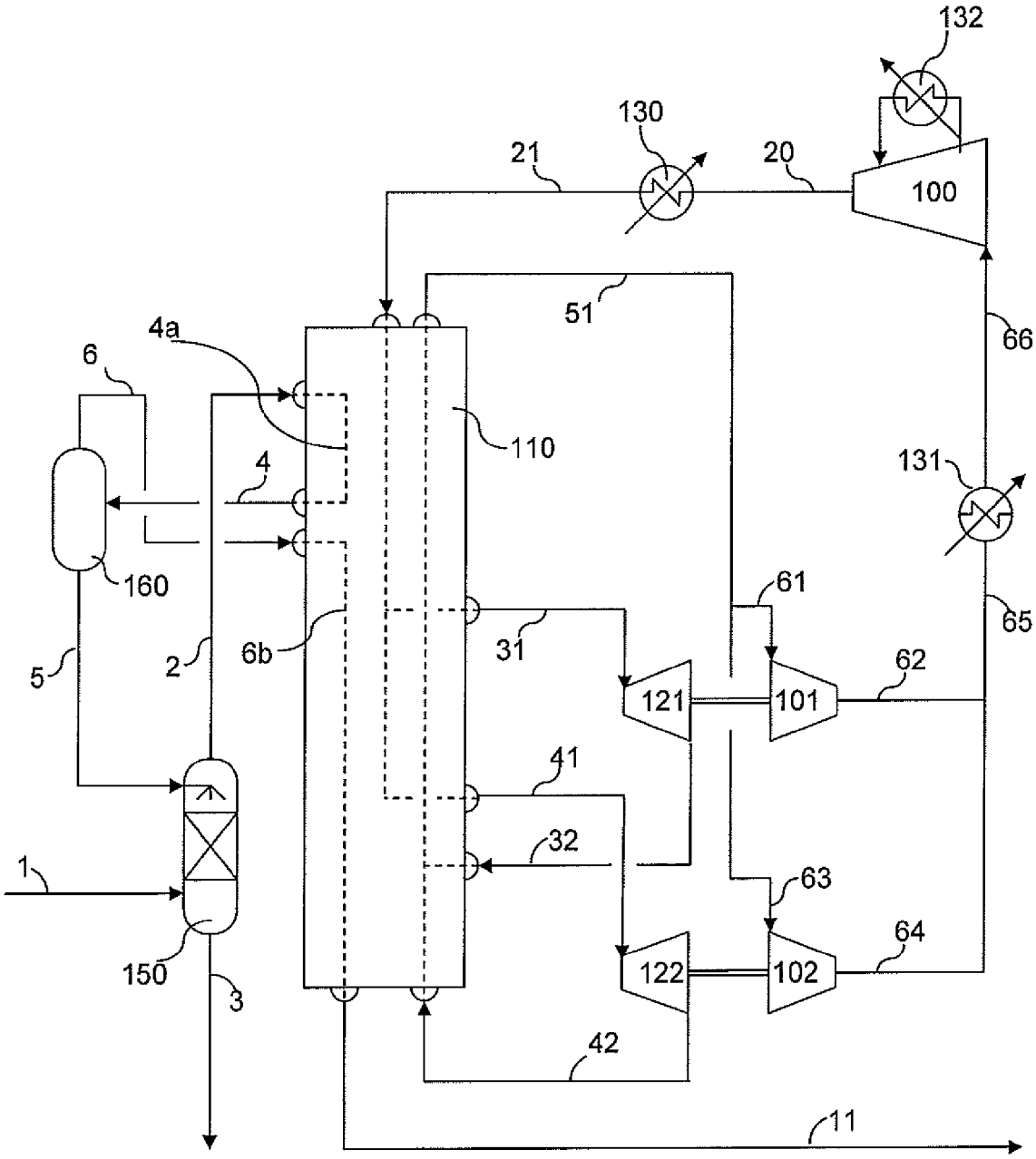
FIG. 7*a* shows a split flow closed gas expansion cooling cycle for pre-cooling, condensation and sub cooling of natural gas using the invention
Figure 7B:
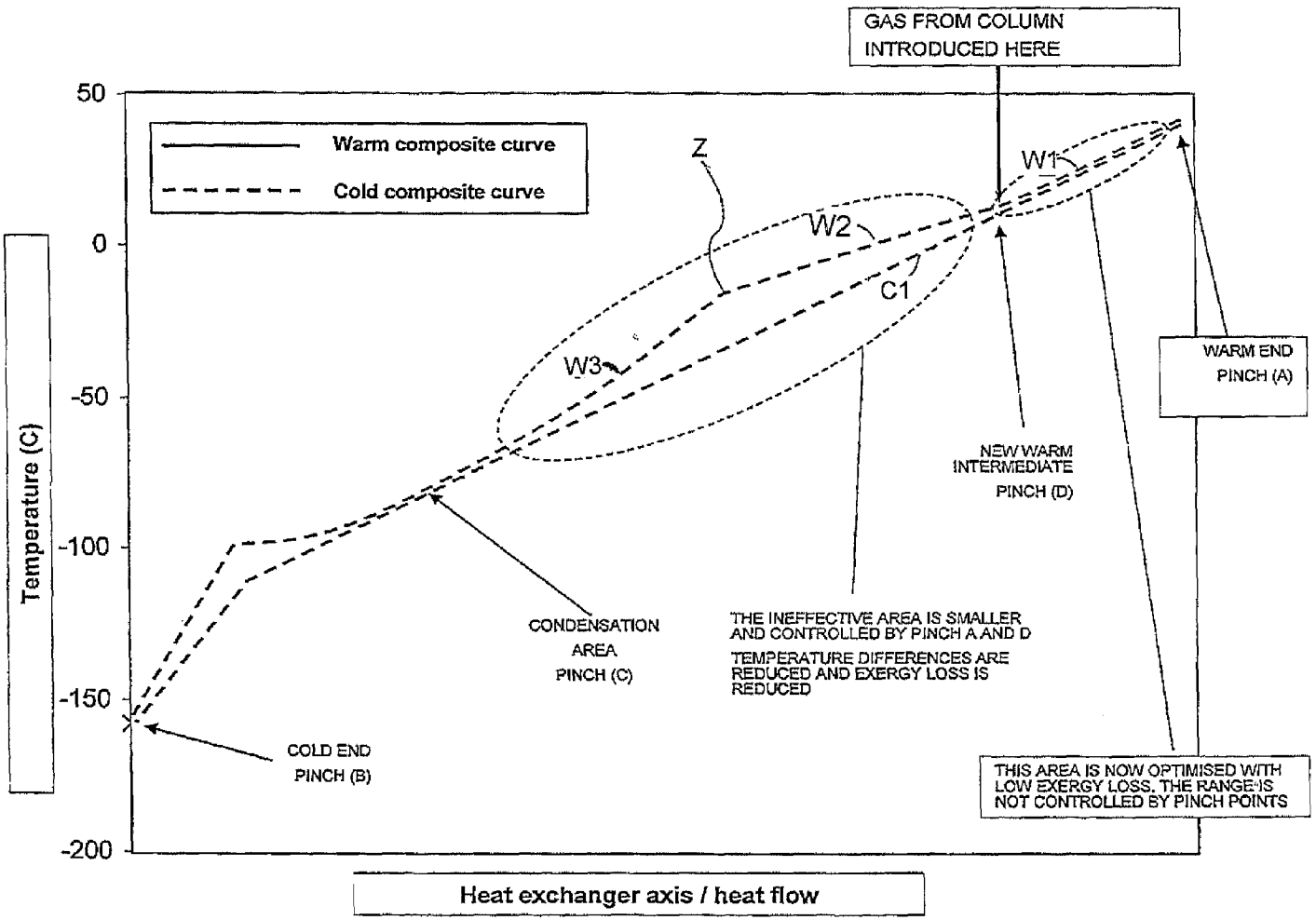
FIG. 7*b* shows an example of a hot temperature curve and a cold temperature curve (composite curve) for a closed gas expansion circuit obtained by using the present invention.

FIG. 7*a* shows a dual (split flow) closed gas expansion process according to the invention, for cooling, condensing and sub cooling an incoming gas stream (1). Heavy hydrocarbons are first removed from an incoming gas stream (1) in the column (150) by counter current contact with a cold reflux liquid (5). This contacting separates C6+ hydrocarbons and reduces the gas temperature of the overhead gas stream (2). The overhead gas stream (2) can therefore be introduced in the heat exchanger system (100) at a lower temperature than without the column. The overhead gas stream is precooled to an intermediate temperature 2-phase stream (4) in the heat exchanger system by means of the dual gas expansion cooling system, separation of said stream in a separator (160), leading the overhead gas (6) from the separator back to the heat exchanger system for further cooling, condensation and sub cooling, and leading the heavy liquid stream (5) back to the column as cold reflux. With reference to FIG. 7*b* and FIG. 9, in the warm end of the heat exchanger the warm composite curve (W1) (sum of warm streams being cooled down) consists of gaseous cooling agent streams 31 and 41, and is therefore linear. In the same temperature range, the cold composite curve (C1) (sum of all cold streams being heated) is consisting of cold gaseous cooling agent streams 32 and 42 being heated. The streams are pure gaseous and heat flow vs. temperature has a linear relation, hence are the C1 composite curve linear shape also. The total mass flow of streams 31 and 32 equals the total mass flow of 41 and 42, hence W1 and C1 have the same slope, and a very good temperature approach can be achieved. After introduction of gas stream 2 from the column, the warm composite curve (W2) consists of warm, high-pressure gaseous cooling agent streams 31 and 41, and the hydrocarbon streams 4*a* and 6*b*. The curve is still relatively linear since almost no condensation occurs, but the slope has changed due to added mass flow (4*a* and 6*b*). This creates a new pinch point (pinch D) at the point where stream 2 is introduced. At the point where nitrogen stream 31 is extracted for expansion, the continued warm composite curve (W3) is consisting of the smaller cooling agent stream 41 and the hydrocarbon stream 6*b*, where the latter is starting to condense. The W3 curve is now strongly controlled by condensation, therefore the curved shape. The curved shape creates a pinch point (pinch C) at some temperature. In the same temperature range, the cold composite curve (C1) (sum of all cold streams being heated) is consisting of cold gaseous cooling agent streams 32 and 42 being heated. The streams are pure gaseous and heat flow vs. temperature has a linear relation, hence are the C1 composite curve linearly shaped. From FIG. 6*b* it can be seen that an envelope is formed, limited by the new pinch point D and the condensation area pinch point C. In the envelope the general temperature differences are large and this means high energy loss, causing higher demand for compression work in the cooling cycle. However, the range and difference is now smaller than for the conventional dual gas expansion cycle, and the losses are smaller. In practise this can be seen as reduced cooling agent flow rate for the modified process according to this invention, resulting in less compression work for the same cooling work.

Figure 8:
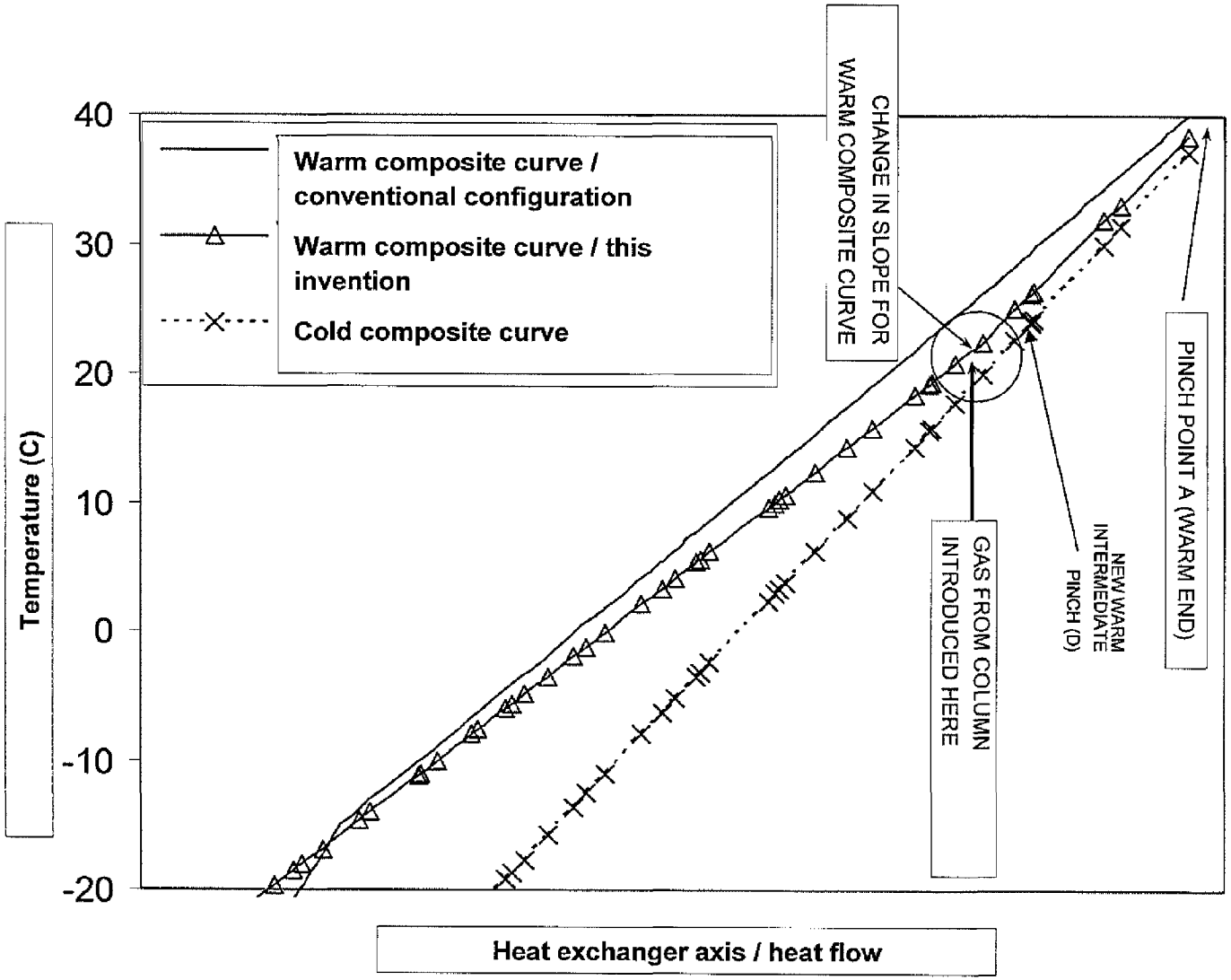
FIG. 8 shows a comparison of the curves shown in the FIGS. 6*b* and 7*b*.

FIG. 8 shows details in the pinch D area where the slope of the warm composite curve is changing for the new invention. The figure also shows the path of the corresponding curve for a conventional version of the cycle.

While reducing feed gas (2) temperature by the use of external pre-cooling (as in base load systems) may also effect pinch point, the effect is negligible in such systems since external pre-cooling will require additional refrigeration work, since it is assumed that all ambient cooling possible is already used. With the present invention a surprising increase in efficiency is realized as this additional cooling work is achieved integral with the process as the cooling work is provided by the cold reflux liquid (5) exchanging heat in counter current contact with the feed gas in the column (150). No external refrigeration work is needed to achieve a temperature lower than the heat exchanger (100) warm end temperature, An additional effect achieved with the present invention is that the heavier hydrocarbons, which are preferably separated out to prevent freezing during the liquefaction, will be condensed and be separated out at considerably higher temperatures than in conventional methods, in that much of the condensing takes place in the fractionation column and not in the heat exchanger at a lower temperature. This reduces the required cooling work at that said lower temperature, hence reduced energy loss in the cooling process in that a cooling duty is moved to a higher temperature range.

Preliminary analyses and comparisons show that necessary compressor work per kg liquid natural gas which is produced can be reduced by 5-15% for a gas expansion circuit carried out in accordance with the invention compared to conventional methods.

EXAMPLE 1

The example below shows natural gas with 90.4% methane by volume which is to be liquefied, where the invention is used to maximise the amount of liquid gas and at the same time minimise the by-production of unstable hydrocarbon liquid with a high content of ethane, propane and butane. The stream data refer to FIG. 1, 2, 3, 4 or 5.

| Stream No. | 1 | 2 | 3 | 4 | 5 | 6 | 11 |
|---|---|---|---|---|---|---|---|
| Gas fraction | 1.00 | 1.00 | 0.00 | 0.95 | 0.00 | 1.00 | 0.00 |
| Temperature (° C.) | 40.0 | 19.2 | 35.9 | −20.0 | −20.0 | −20.0 | −155.0 |
| Pressure (kPa abs) | 2740 | 2738 | 2745 | 2725 | 2730 | 2723 | 2655 |
| Mole flow (kmol/h) | 4232 | 4422 | 44 | 4422 | 235 | 4185 | 4185 |
| Mass flow (kg/h) | 78980 | 87539 | 3410 | 87539 | 11969 | 75541 | 75541 |
| Mole fraction (%) | | | | | | | |
| Nitrogen | 0.51% | 0.49% | 0.02% | 0.49% | 0.03% | 0.52% | 0.52% |
| Methane | 90.4% | 87.4% | 11.8% | 87.4% | 19.5% | 91.3% | 91.3% |
| Ethane | 4.38% | 4.53% | 2.58% | 4.53% | 6.84% | 4.40% | 4.40% |
| Propane | 2.29% | 2.95% | 4.17% | 2.95% | 15.04% | 2.27% | 2.27% |

-continued

| Stream No. | 1 | 2 | 3 | 4 | 5 | 6 | 11 |
|---|---|---|---|---|---|---|---|
| i-Butane | 0.68% | 1.25% | 2.80% | 1.25% | 11.92% | 0.65% | 0.65% |
| n-Butane | 0.66% | 1.52% | 3.79% | 1.52% | 17.30% | 0.62% | 0.62% |
| i-Pentane | 0.17% | 0.70% | 2.52% | 0.70% | 10.57% | 0.14% | 0.14% |
| n-Pentane | 0.17% | 0.79% | 3.61% | 0.79% | 12.49% | 0.12% | 0.12% |
| n-Hexane | 0.44% | 0.32% | 43.62% | 0.32% | 6.25% | 0.02% | 0.02% |
| n-Heptane | 0.19% | 0.00% | 18.29% | 0.00% | 0.02% | 0.00% | 0.00% |
| n-Octane | 0.055% | 0.000% | 5.187% | 0.000% | 0.000% | 0.000% | 0.000% |
| n-Nonane | 0.014% | 0.000% | 1.339% | 0.000% | 0.000% | 0.000% | 0.000% |
| n-Decane+ | 0.002% | 0.000% | 0.214% | 0.000% | 0.000% | 0.000% | 0.000% |

EXAMPLE 2-5

The examples below shows example of the percentage of feed gas pr. component in some of the key streams with the present invention, for different methane content in feed gas.

PERCENT OF FEED GAS FOR EACH STREAM FOR A 97 VOL % METHANE FEED GAS

| COMPONENT | REFLUX | LNG | CONDENSATE | COLUMN OVERHEAD |
|---|---|---|---|---|
| N2 | 4.4% | 100.0% | 0.0% | 104.4% |
| C1 | 10.7% | 99.9% | 0.1% | 110.6% |
| C2 | 49.1% | 99.4% | 0.6% | 148.5% |
| C3 | 146.3% | 98.2% | 1.8% | 244.5% |
| C4 | 363.7% | 94.7% | 5.3% | 458.3% |
| C5 | 701.3% | 68.0% | 31.9% | 769.3% |
| C6 | 11.1% | 0.3% | 99.7% | 11.4% |
| C7 | 0.1% | 0.0% | 100.0% | 0.1% |
| C8 | 0.0% | 0.0% | 100.0% | 0.0% |
| C9 | 0.0% | 0.0% | 100.0% | 0.0% |
| C10+ | 0.0% | 0.0% | 100.0% | 0.0% |

PERCENT OF FEED GAS FOR EACH STREAM FOR A 95 VOL % METHANE FEED GAS

| COMPONENT | REFLUX | LNG | CONDENSATE | COLUMN OVERHEAD |
|---|---|---|---|---|
| N2 | 3.1% | 100.0% | 0.0% | 103.1% |
| C1 | 8.6% | 99.9% | 0.1% | 108.5% |
| C2 | 45.7% | 99.4% | 0.6% | 145.2% |
| C3 | 151.6% | 98.1% | 1.9% | 249.7% |
| C4 | 393.5% | 91.2% | 8.8% | 484.6% |
| C5 | 129.8% | 11.1% | 88.9% | 140.9% |
| C6 | 0.8% | 0.0% | 100.0% | 0.9% |
| C7 | 0.0% | 0.0% | 100.0% | 0.0% |
| C8 | 0.0% | 0.0% | 100.0% | 0.0% |
| C9 | 0.0% | 0.0% | 0.0% | 0.0% |
| C10+ | 0.0% | 0.0% | 0.0% | 0.0% |

PERCENT OF FEED GAS FOR EACH STREAM FOR A 93 VOL % METHANE FEED GAS

| COMPONENT | REFLUX | LNG | CONDENSATE | COLUMN OVERHEAD |
|---|---|---|---|---|
| N2 | 17.6% | 99.3% | 0.7% | 116.8% |
| C1 | 7.2% | 99.7% | 0.3% | 106.9% |
| C2 | 37.3% | 98.6% | 1.4% | 135.8% |
| C3 | 119.2% | 95.4% | 4.6% | 214.6% |
| C4 | 269.6% | 78.6% | 21.3% | 348.3% |
| C5 | 43.9% | 4.9% | 95.3% | 48.9% |
| C6 | 0.3% | 0.0% | 100.0% | 0.3% |
| C7 | 0.0% | 0.0% | 100.0% | 0.0% |

-continued

PERCENT OF FEED GAS FOR EACH STREAM FOR A 93 VOL % METHANE FEED GAS

| COMPONENT | REFLUX | LNG | CONDENSATE | COLUMN OVERHEAD |
|---|---|---|---|---|
| C8 | 0.0% | 0.0% | 100.0% | 0.0% |
| C9 | 0.0% | 0.0% | 100.0% | 0.0% |
| C10+ | 0.0% | 0.0% | 100.0% | 0.0% |

PERCENT OF FEED GAS FOR EACH STREAM FOR A 88 VOL % METHANE FEED GAS

| COMPONENT | REFLUX | LNG | CONDENSATE | COLUMN OVERHEAD |
|---|---|---|---|---|
| N2 | 1.7% | 99.6% | 0.4% | 101.3% |
| C1 | 4.5% | 99.0% | 1.0% | 103.5% |
| C2 | 21.1% | 95.8% | 4.1% | 116.9% |
| C3 | 60.5% | 87.5% | 12.2% | 148.0% |
| C4 | 113.5% | 63.6% | 36.5% | 177.1% |
| C5 | 24.2% | 5.1% | 95.9% | 29.3% |
| C6 | 0.3% | 0.0% | 100.0% | 0.3% |
| C7 | 0.0% | 0.0% | 100.0% | 0.0% |
| C8 | 0.0% | 0.0% | 100.0% | 0.0% |
| C9 | 0.0% | 0.0% | 100.0% | 0.0% |
| C10+ | 0.0% | 0.0% | 100.0% | 0.0% |

The invention claimed is:

1. Method for optimizing a warm end of a heat exchanger system of a process for liquefaction of a feed gas comprising hydrocarbons, the process employing a gas expansion cycle for providing cooling in a heat exchanger system, the gas expansion cycle comprising a compressor for cooling agent compression, the method comprising the steps of:

a) enriching the feed gas with butane and hydrocarbons with a lower boiling point than butane by i) feeding the feed gas to a fractionation column where the feed gas is cooled in contact with a cold fluid rich in propane, butane and pentane and separated into a first overhead fraction with reduced content of hydrocarbons having molecular weight heavier than pentane, and a bottom fraction;

ii) the first overhead fraction being cooled in the heat exchanger system and partially condensed;

iii) separating the partially condensed first overhead fraction in a separator to generate said cold fluid rich in propane, butane and pentane, and a second overhead fraction enriched with a majority of the butane and hydrocarbons with a lower boiling point than butane that were contained in the feed gas, said second overhead fraction being further cooled down and liquefied in the heat exchanger system;

iv) operating the fractionation column and the separator at pressure and temperature such that said column and separator generate a separation of components in the feed gas at a normal boiling point range between −12° C. and 60° C.;

b) feeding a gaseous cooling agent to the warm end of the heat exchanger system for heat exchange with a cold gaseous cooling agent stream, the gaseous cooling agent and the cold gaseous cooling agent in the warm end of the heat exchanger having linear heat versus temperature relation;

c) leading said first overhead fraction to the heat exchanger system at a lower temperature than the heat exchanger system warm end temperature, wherein the introduction of the first overhead fraction causes a change of slope of a warm composite curve at the point where the first overhead fraction is introduced;

wherein the mass flow of gaseous cooling agent can be reduced such that a better temperature adaption between the gaseous and cold gaseous cooling agent streams is achieved in the warm end of the heat exchanger system, and required compression work for the cooling in the heat exchanger system can be reduced.

2. Method according to claim 1, wherein the gaseous cooling agent is cooled at a first pressure to a temperature between 0° C. and −120° C. in heat exchange with the said cold gaseous cooling agent stream, and thereafter expanded in a gas expander to a lower pressure lower than said first pressure to generate the cold gaseous cooling agent stream.

3. Method according to claim 2, wherein the gas expander comprises an expansion turbine, where the gaseous cooling agent stream is expanded at high isentropic efficiency from a first pressure between 3 and 10 MPa, to a second, lower pressure between 5%-40% of said first pressure.

4. Method according to claim 3, wherein the second, lower pressure is between 10% and 30% of the first pressure.

5. Method according to claim 1, wherein the gaseous cooling agent is nitrogen.

6. Method according to claim 1, wherein the cold gaseous cooling agent stream is heated in the heat exchanger system and thereafter is compressed and cooled with external cooling, and thereafter reused as the gaseous cooling agent at a higher pressure.

7. Method according to claim 1, wherein the gaseous cooling agent is split into a plurality of cooling agent parts, the cooling agent parts are cooled to different temperatures and expanded in gas expanders, thereafter returning the expanded cooling agent parts to different inlet locations on the heat exchanger system.

8. Method according to claim 7, wherein the said cooling agent parts are cooled to the said different temperatures in separate flow channels in the heat exchanger system.

9. Method according to claim 7, wherein the expanded cooling agent parts are heated in separate flow channels in the heat exchanger system.

10. Method according to claim 1, wherein the said component separation at the normal boiling point range between −12° C. and 60° C. corresponds to butane (C4) with a normal boiling point between −12° C. and 0° C. being a light key component to the separation, and a C6 component with a boiling point between 50° C. and 70° C. being a heavy key component to the separation.

11. Method according to claim 1, wherein the said second overhead fraction from the separator, relative to the feed gas, consists essentially of from 87.5% to 98.2% of the propane of the feed gas, from 63.6% to 94.7% of the butanes of the feed gas, from 5.1% to 68% of the pentanes of the feed gas, and less than 4.5% of the hexane of the feed gas.

12. Method according to claim 1, wherein before introduction of said first overhead fraction the warm streams being cooled down in the warm end of the heat exchanger system consist of gaseous cooling agent streams, and after introduction of said first overhead fraction the warm streams being cooled down consist of gaseous cooling agent streams and said first overhead fraction.

* * * * *